United States Patent [19]

Reichard et al.

[11] Patent Number: 4,589,635

[45] Date of Patent: May 20, 1986

[54] POROUS PLUG RETAINER

[75] Inventors: James E. Reichard, Youngstown; Robert L. Hamilton, Boardman, both of Ohio

[73] Assignee: Pollock Company, Youngstown, Ohio

[21] Appl. No.: 613,260

[22] Filed: May 24, 1984

[51] Int. Cl.[4] ..... C21C 5/48; B22D 41/08; B67D 5/00; C21B 7/16

[52] U.S. Cl. ..... 266/220; 222/601; 222/603; 266/265

[58] Field of Search ..... 222/601, 603, 597, 598, 222/599; 266/45, 220, 224, 275, 287, 265; 75/59, 60

[56] References Cited

U.S. PATENT DOCUMENTS

| | | | |
|---|---|---|---|
| 1,647,052 | 10/1927 | Osolin . | |
| 1,835,838 | 12/1931 | Anderson, Jr. | |
| 2,811,346 | 10/1957 | Spire | 266/220 |
| 2,830,806 | 4/1958 | Yuhas et al. | |
| 2,842,353 | 7/1958 | Priola . | |
| 2,871,008 | 1/1959 | Spire | 266/220 |
| 3,259,484 | 7/1966 | Leroy et al. | |
| 3,343,829 | 9/1967 | Coates | 266/220 |
| 3,971,548 | 7/1976 | Folgero et al. | |
| 4,076,224 | 2/1978 | Duchateau . | |
| 4,208,042 | 6/1980 | Aichert et al. | |
| 4,298,147 | 11/1981 | Honda et al. | 222/601 |
| 4,298,192 | 11/1981 | Barbakadze et al. . | |
| 4,331,471 | 5/1982 | Langenfeld et al. . | |
| 4,353,535 | 10/1982 | Humberstone . | |
| 4,360,190 | 11/1982 | Ato . | |

FOREIGN PATENT DOCUMENTS

| | | | |
|---|---|---|---|
| 1421793 | 1/1976 | United Kingdom | 266/220 |

*Primary Examiner*—Joseph J. Rolla
*Assistant Examiner*—Gregory L. Huson
*Attorney, Agent, or Firm*—Hill, Van Santen, Steadman & Simpson

[57] ABSTRACT

A porous plug retainer which can be mounted in a hot metal ladle or similar vessel for locating, installing and retaining an argon porous plug so as to allow service and maintenance of the porous plug to be performed from outside the vessel. The porous plug retainer is comprised of two subassemblies with the first subassembly welded to the bottom of the hot metal ladle and machined to accept a female refractory block into which the porous plug is inserted. The porous plug is formed so that it fits and mates with the opening in the female refractory block and the second subassembly can be joined to the first subassembly so as to lock the members together. The second subassembly is mounted on a hinge to allow it to move linearly and then radially to clear the porous plug while opening. The invention allows the porous plug to be properly aligned in the refractory block and a threaded seat allows the porous plug to be firmly positioned in the refractory block.

2 Claims, 5 Drawing Figures

POROUS PLUG RETAINER

BACKGROUND OF THE INVENTION

1. Field of the Invention

This invention relates in general to metal working and in particular to a novel porous plug retainer for a ladle or a similar vessel which contains hot metal.

2. Description of the Prior Art

In metal working it is necessary at times to place the molten metal into a ladle into which an inert gas is supplied from the bottom so as to stir the metal. The hot metal which might be at a temperature of around 3000° is poured into the ladle which is held on hooks by a couple of pins so that the ladle can be pivoted. The metal can be removed from the ladle by tapping through a hole. Generally, there is another opening formed through the ladle refractory lining and the outer shell of the ladle in which a porous plug is mounted so that a mixing and stiring gas such as argon can be injected through the porous plug so as to stir the metal. Since argon is inert gas, no reaction occurs but the metal is stirred with the injection. In the prior art, the porous plug has been inserted from inside the ladle and is fitted into the lining refractory material from the inside of the ladle. In the prior art, the porous plug was mounted in the ladle and the supply pipe was extended through a small opening of an inch and a half or two inches in the bottom of the ladle and then the refractory block was put over the plug and then the rest of the bricking on the inside of the ladle was done.

SUMMARY OF THE INVENTION

The present invention allows a porous plug to be mounted into a female refractory block of a ladle from outside of the ladle and includes two subassembly portions with the first portion comprising a generally cylindrical outer sleeve which is welded to an opening in the ladle and the porous plug which is generally conical shape is passed up through the first subassembly into a mating female conical opening in the female refractory block after which a second subassembly which is pivotally connected to the ladle fits over the supply pipe to the porous plug and is attached to the first subassembly with a number of pins and keys so as to lock it to the first subassembly. The second subassembly is provided with a threaded member which when rotated will move upwardly to press the porous plug firmly into the opening of the female refractory block. The porous plug can be replaced by disconnecting the second subassembly from the first subassembly and pivoting it away from the first member so that the porous plug can be removed and a new porous plug inserted into the female refractory block. Then the second subassembly can again be attached to the first subassembly and adjusted to hold the porous plug firmly in position. Thus, the present invention allows a porous plug in a metal processing vessel to be simply and easily removed.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
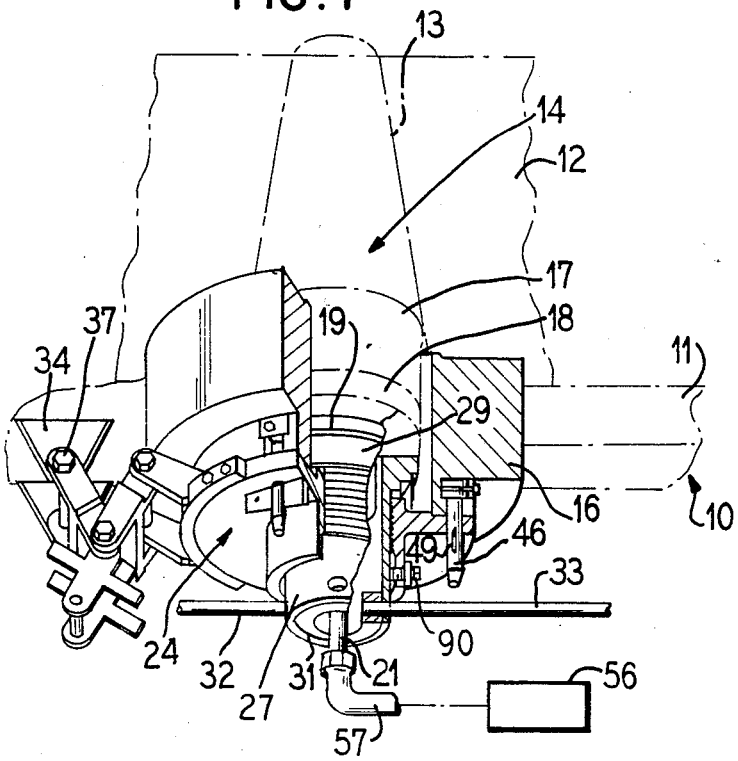
FIG. 1 is a partially cutaway perspective view of the invention.

The Figures illustrate the invention for holding a porous plug in a ladle vessel 10. The ladle vessel 10 has a bottom wall 11 in which an opening is received into which a first subassembly collar member 16 is mounted as, for example, by welding to the ladle bottom 11 as illustrated, for example, in FIGS. 1, 3, 4 and 5. A female refractory block 12 is mounted inside the metal vessel 10 and is formed with a conical-shaped opening 13 into which a porous plug 14 can be inserted so that a suitable gas as, for example, argon can be bubbled up through the molten metal in the ladle vessel. A second subassembly member 22 can be detachably connected to the first collar subassembly member 16 by a plurality of pins 46, 51 and 60 which are formed with key ways such as the key way 49 illustrated in FIG. 2 through which a key 48 can be inserted to lock the members 16 and 22 together. Set screws 47 attach the pin 46 to the member 16 as shown in FIG. 2. The second subassemble member 22 comprises a disk-shaped member 23 which is formed with openings through which the pins 46, 51 and 60 extend and the keys 48, 65 and 70 are receivable through key ways in the pins 46, 51 and 60 as illustrated in FIG. 4 so as to lock the member 22 to the member 16. A lower hollow cylindrical portion 24 extends from the diskshaped member 23 and has internal threads 26 which mate with threads 28 of a sleeve member 27 which has an upper bearing member 29 for engaging a first plate 19 which bears on a second plate 18 which in turn bears on the refractory plate 17 which engages the bottom end of the porous plug 14. The gas furnishing pipe 21 extends through the plates 17, 18 and 19 to supply gas to the porous plug 14.

Handles 32 and 33 can be inserted into openings in the lower end 31 of sleeve 27 to allow the sleeve 27 to be rotated relative to the threads 26 thus, adjusting the sleeve 27 relative to the member 24 so as to move the plug 14 up into the opening 13.

Figure 3:
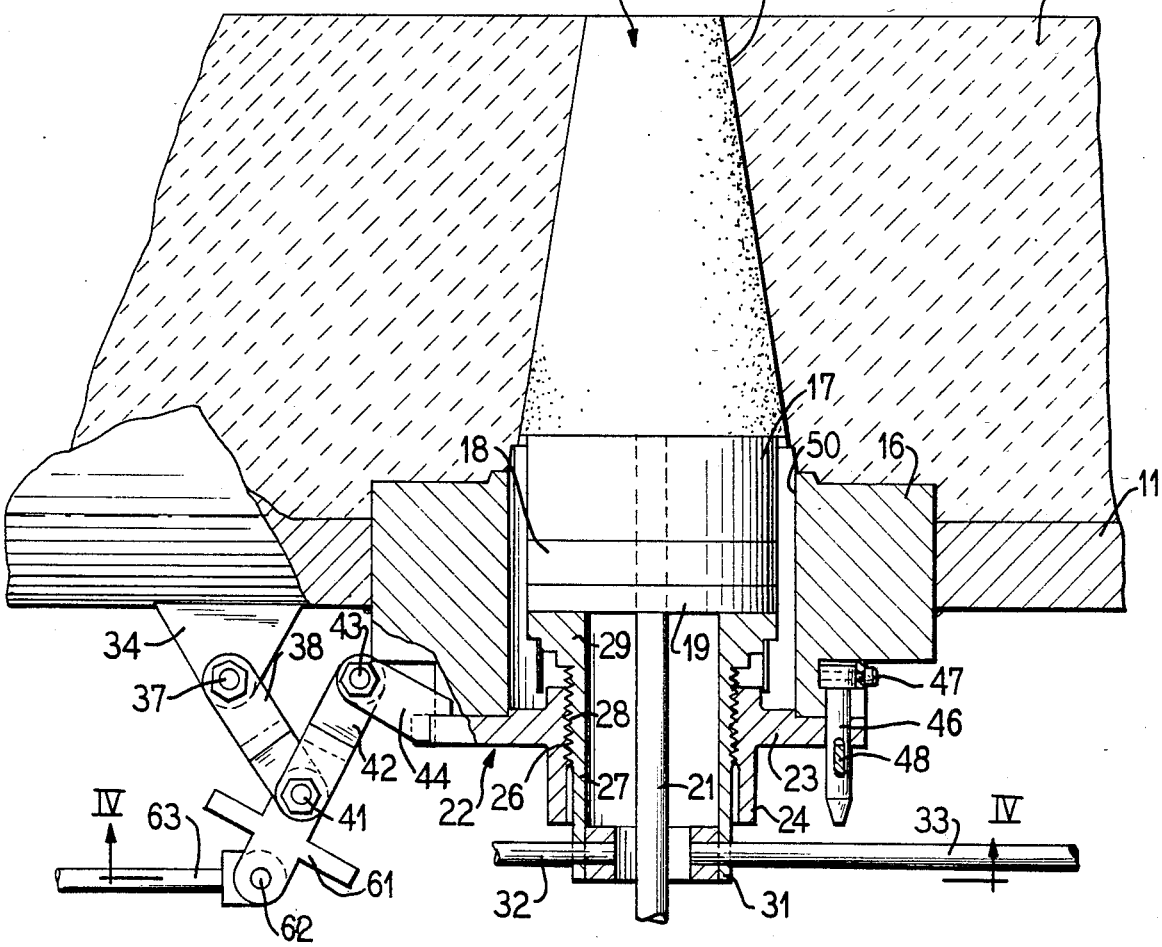
FIG. 3 is a sectional view illustrating the invention.
Figure 4:
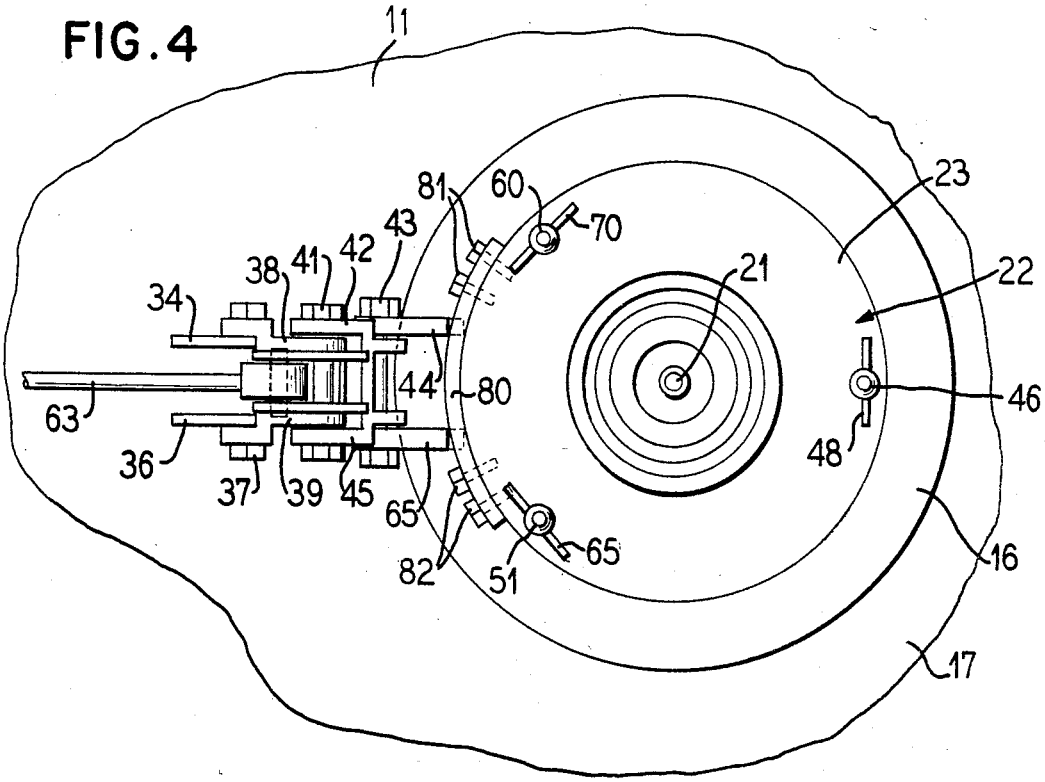
FIG. 4 is a bottom plan view of the invention.
Figure 5:
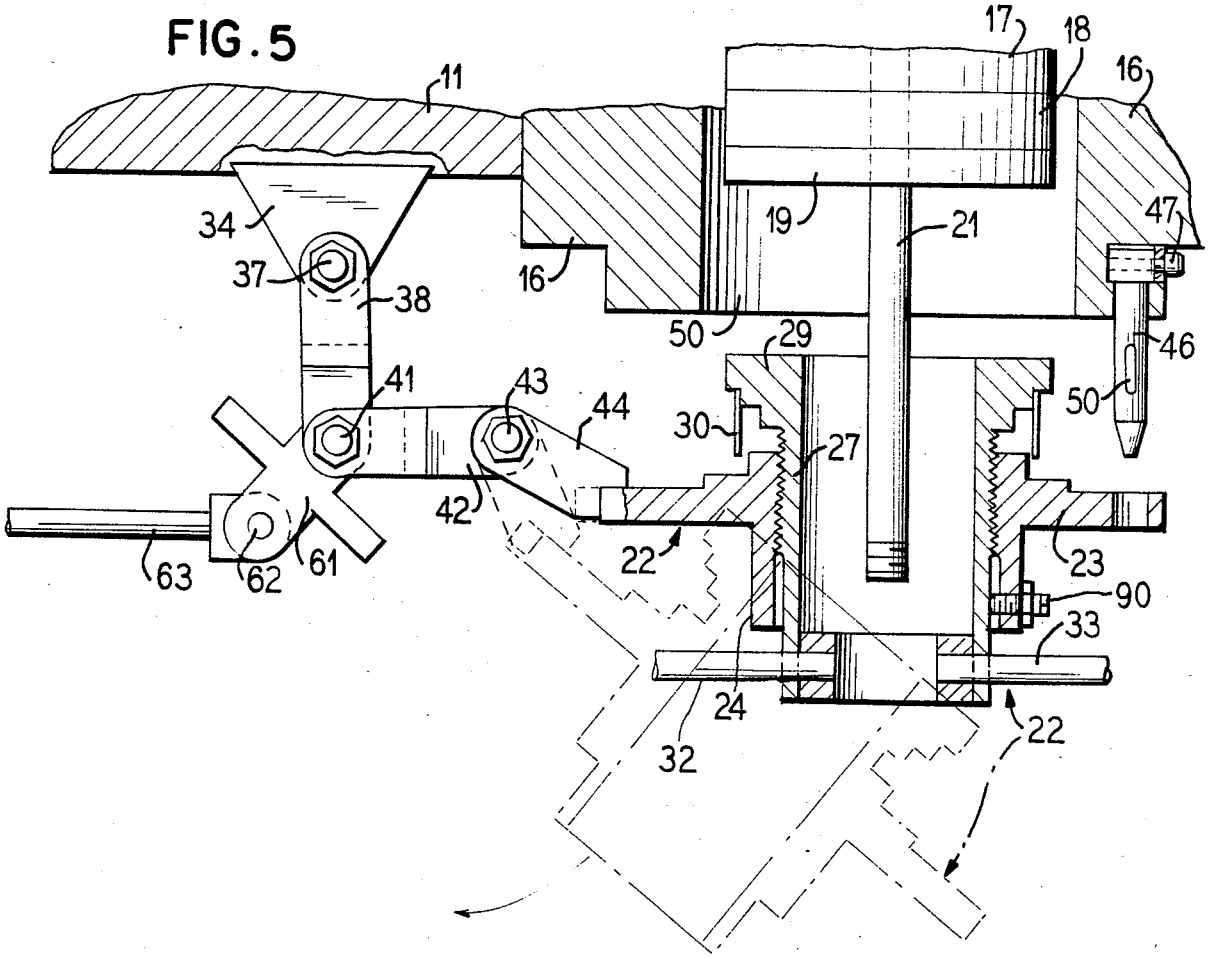
FIG. 5 is a sectional view illustrating the first and second subassemblies disconnected from each other.

The disk portion 23 of member 22 is hinged to the bottom of the ladle 11 with a linkage comprising brackets 34 and 36 through which a pin 37 extends to pivotally support links 38 and 39 illustrated in FIG. 3, 4 and 5 for example. A pin 41 extends through the links 38 and 39 and pivotally attaches links 42 and 45 to the links 38 and 39. Pin 43 attaches links 44 and 65 to the links 42 and 45 and the other end of the links 44 and 65 are welded to the disk-shaped member 23. An actuating handle 63 is connected by pin 62 to the links 61 which have their other end connected by pin 41 to the links 38 and 42 as illustrated in FIG. 5, for example.

Figure 2:
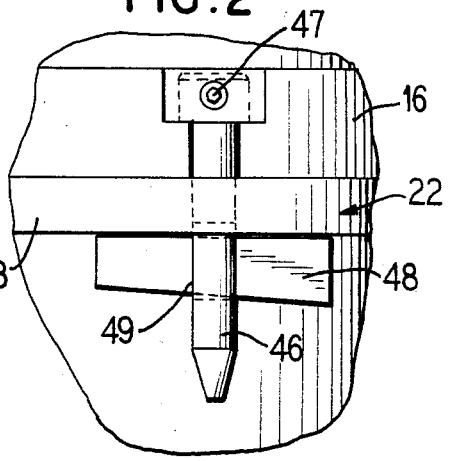
FIG. 2 is a detail view showing the locking pin and key for holding the second subassembly to the first subassembly.

A supply of gas can be furnished from a reservoir 56 through a coupling pipe 57 to the lower end of pipe 21 as illustrated in FIG. 1.

In operation, when a porous plug 14 is to be changed, the coupling pipe 57 is removed from the lower end of the gas supply pipe 21 and the handles 32 and 33 are used to rotate the member 27 so as to move the member 29 downwardly away from the plates 17, 18 and 19. Then the keys 48, 65 and 70 are removed from the pins 46, 51 and 60 and the second subassembly 22 can then be moved downwardly off of the pins to the position illustrated in solid line in FIG. 5, for example. Then the second subassembly member 22 can be moved to the dashed-dotted position illustrated in FIG. 5 and swung back out of the way of the opening 30 through the member 16 so that the plates 17, 18, and 19 and pipe 21 can be removed from the member 16 as well as the porous plug 14. A replacement porous plug 14 may be then reinserted through the opening 30 into the opening 13 of the refractory block 12 and the plates 17, 18 and 19 and pipe 21 and the second subassembly 22 may be moved over the end of the pipe 21 and up to the position illustrated in FIG. 5 in solid line. Then the member 22 may be moved up over the pins 46, 51 and 60 and the keys 48, 65 and 70 inserted through the pins so as to lock the first and second subassenblies together. The inner collar 27 can then be rotated with handles 32 and 33 so as to firmly press the plates 17, 18 and 19 up against the porous plug 14 to center it and firmly mount it in place. The coupling pipe 57 can then be connected to the lower end of the pipe 21 for furnishing gas to the porous plug.

A locking pin 90 locks the member 27 to the member 24 and a skirt 30 extends downwardly from member 29 as shown in FIG. 5.

It is seen that this invention allows simple and easy change in replacement of porous plugs in a molten metal vessel which can be changed from outside of the vessel. Although the invention has been described with respect to preferred embodiments, it is not to be so limited as changes and modifications may be made therein which are within the full and intended scope as defined by the appended claims.

We claim as our invention:

1. A porous plug retainer for a container comprising, a circular opening formed in a bottom wall of said container, a first cylindrical member attached to said bottom wall about said circular opening, a refractory block mounted in said container and having a conical shaped opening aligned with said opening in said bottom wall of said container and said first cylindrical member, a porous conical shaped plug receivably mounted in said conical shaped opening in said refractory block, a second member detachably connected to said first cylindrical member and having a cylindrically shaped porous plug engaging portion which is engageable with said porous plug, said second member having a threaded sleeve threadedly received in said second member and engageable with said porous plug engaging portion for adjusting the vertical position of said porous plug, a first handle attached to said threaded sleeve to rotate it, a set screw threadedly received through said second member and engageable with said threaded sleeve to lock it in a fixed position, a pipe attached to said porous plug engaging portion and extending downwardly through said second member and below said threaded sleeve, a first pair of links pivotally attached to the lower surface of said container, a second pair of links with first ends pivotally attached to said first pair of links with their other ends pivotally attached to said second member, and an actuating handle pivotally attached to said first and second pair of links and said second member movable downwardly and over the lower end of said pipe to allow said second member to move to a position so that said conical plug can be replaced.

2. A porous plug retainer according to claim 1 wherein said second member is attached to said first cylindrical member by a plurality of pins which extend from said first cylindrical member and pass through aligned openings of said second member and receive retaining means to lock said first cylindrical and second members together.

* * * * *